US010382858B1

(12) United States Patent
Singer et al.

(10) Patent No.: US 10,382,858 B1
(45) Date of Patent: Aug. 13, 2019

(54) SYSTEM AND METHOD FOR REDUCING SPEAKER VIBRATION

(71) Applicant: GM Global Technology Operations LLC, Detroit, MI (US)

(72) Inventors: Ian R. Singer, Macomb, MI (US); Dargham Alyassiry, Dearborn Heights, MI (US); Runhong Deng, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/904,628

(22) Filed: Feb. 26, 2018

(51) Int. Cl.

| | |
|---|---|
| ***H04R 1/28*** | (2006.01) |
| ***H04R 9/06*** | (2006.01) |
| ***H04R 1/40*** | (2006.01) |
| ***H04R 1/02*** | (2006.01) |

(52) U.S. Cl.
CPC ..... *H04R 1/28* (2013.01); *H04R 1/025* (2013.01); *H04R 1/40* (2013.01); *H04R 9/06* (2013.01)

(58) Field of Classification Search
CPC ... H04R 1/28; H04R 1/02; H04R 1/40; H04R 9/06; H04R 1/2888
USPC ..... 381/386, 345, 348, 392; 181/151, 156
See application file for complete search history.

(56) References Cited

U.S. PATENT DOCUMENTS

| | | | | |
|---|---|---|---|---|
| 4,727,584 | A | 2/1988 | Hall | |
| 5,298,693 | A * | 3/1994 | Heijn | A47B 81/06 181/199 |
| 6,845,841 | B2 * | 1/2005 | Smith | F16F 15/08 181/207 |
| 2001/0024509 | A1 | 9/2001 | Carver | |
| 2011/0129113 | A1 * | 6/2011 | Kumakura | H04R 7/14 381/423 |

* cited by examiner

*Primary Examiner* — Melur Ramakrishnaiah

(57) ABSTRACT

A vibration reduction assembly includes a mass and an actuator. The mass is configured to be attached to a rear plate or a frame of a speaker in a manner that allows the mass to move along a longitudinal axis of a pole of the rear plate. The mass is sized to yield a force that is equal in magnitude and opposite in direction relative to a force generated by moving components in the speaker and acoustic pressure of the speaker. In one example, the actuator is configured to move the mass in phase with movement of a voice coil of the speaker along the longitudinal axis of the pole and in an opposite direction than the voice coil movement. In another example, the actuator is configured to move the mass out of phase with the voice coil movement and in the same direction as the voice coil movement.

20 Claims, 6 Drawing Sheets

SYSTEM AND METHOD FOR REDUCING SPEAKER VIBRATION

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to systems and methods for reducing speaker vibration.

A speaker typically includes a rear plate, a front plate, a magnet, a voice coil, a suspension, a basket or frame, a cone or diaphragm, and a surround. The rear plate includes a base and a pole axially projecting from the base. The front plate is mounted within the frame and includes a radially inner surface defining a hole through which the pole of the rear plate extends. The magnet is disposed axially between the front and rear plates and also includes a radially inner surface defining a hole through which the pole of the rear plate extends.

The voice coil is disposed in a gap between a radially outer surface of the pole on the rear plate and the radially inner surfaces of the front plate and the magnet. The voice coil generates a magnetic field when a voltage is applied to the voice coil, which repels or attracts the magnetic field of the magnet and therefore cases the voice coil to move axially. The diaphragm extends between the voice coil and the frame and vibrates in response to movement of the voice coil, which causes air pressure fluctuations that generate noise. The surround attaches the diaphragm to the frame while allowing the diaphragm to move axially.

SUMMARY

The present disclosure describes an assembly for reducing vibration generated by a speaker. In one example, the vibration reduction assembly includes a first rear plate, a first front plate, a first magnet, a first voice coil, and a mass. The first rear plate includes a base and a pole projecting from the base in a first direction, the pole having an outer radial surface. The first front plate has an inner radial surface defining a hole through which the pole of the first rear plate extends, the outer radial surface of the pole opposing the inner radial surface of the first front plate. The first magnet is disposed between the first rear plate and the first front plate and surrounds the pole. The first voice coil is disposed between the outer radial surface of the pole and the inner radial surface of the first front plate, and is configured to move in the first direction or in a second direction opposite of the first direction when a voltage is applied to the first voice coil. The mass is attached to the first voice coil and is sized to yield a first force that is equal in magnitude and opposite in direction relative to a second force generated by moving components in the speaker and acoustic pressure of the speaker.

In one example, the vibration reduction assembly is free of any diaphragm.

In one example, the first voice coil has a tubular shape, and the mass includes a disc attached to an inner radial surface of the first voice coil.

The present disclosure also describes a speaker assembly that, in one example, includes the vibration reduction assembly described above and a speaker. The speaker includes a second rear plate, a second front plate, a second magnet, a second voice coil, a frame, and a diaphragm. The second rear plate is attached to the first rear plate of the vibration reduction assembly. The second rear plate includes a base and a pole projecting from the base of the second rear plate, the pole of the second rear plate having an outer radial surface. The second front plate is mounted within the frame. The second front plate has an inner radial surface defining a hole through which the pole of the second rear plate extends, the outer radial surface of the pole of the second rear plate opposing the inner radial surface of the second front plate. The second magnet is disposed between the second rear plate and the second front plate and surrounds the pole of the second rear plate. The second voice coil is disposed between the outer radial surface of the pole of the second rear plate and the inner radial surface of the second front plate and is configured to move in the first or second direction when a voltage is applied to the second voice coil. The diaphragm extends between the second voice coil and the frame and is configured to generate noise in response to movement of the second voice coil.

In one example, the pole of the second rear plate projects from the base of the second rear plate in the second direction.

The present disclosure also describes an audio system that, in one example, includes the speaker assembly described above and electrical wiring configured to electrically connect the speaker assembly to an amplifier such that movement of the first voice coil relative to the first rear plate is in phase with movement of the second voice coil relative to the second rear plate.

In one example, the electrical wiring connects the first and second voice coils to the amplifier in series.

In one example, the electrical wiring connects the first and second voice coils to the amplifier in parallel.

In one example, the audio system includes the speaker assembly described above and an amplifier control module configured to supply a first voltage to the first voice coil and supply a second voltage to the second voice coil. The first voltage is less than the second voltage.

In one example, the pole of the second rear plate projects from the base of the second rear plate in the first direction.

In one example, the audio system includes the speaker assembly described above and electrical wiring configured to electrically connect the speaker assembly to an amplifier such that movement of the first voice coil relative to the first rear plate is out of phase with movement of the second voice coil relative to the second rear plate.

In one example, the electrical wiring connects the first and second voice coils to the amplifier in series.

In one example, the electrical wiring connects the first and second voice coils to the amplifier in parallel.

In one example, the audio system includes the speaker assembly described above and an amplifier control module configured to control an amplifier to send a first signal to the first voice coil and send a second signal to the second voice coil such that movement of the first voice coil relative to the first rear plate is out of phase with movement of the second voice coil relative to the second rear plate.

The present disclosure describes another example of a speaker assembly that includes a speaker and a vibration reduction assembly. The speaker includes a first rear plate, a first front plate, a first magnet, a first voice coil, a frame, and a diaphragm. The first rear plate includes a base and a pole projecting from the base in a first direction, the pole of the first rear plate having an outer radial surface. The first front plate is mounted within the frame. The first front plate has an inner radial surface defining a hole through which the pole of the first rear plate extends, the outer radial surface of the pole opposing the inner radial surface of the first front plate. The first magnet is disposed between the first rear plate and the first front plate and surrounds the pole of the first rear plate. The first voice coil is disposed between the outer radial surface of the pole of the first rear plate and the inner radial surface of the first front plate and is configured to move in the first direction or in a second direction opposite of the first direction when a voltage is applied to the first voice coil. The diaphragm extends between the first voice coil and the frame and is configured to generate noise in response to movement of the first voice coil. The vibration reduction assembly includes a mass and an actuator. The mass is attached to at least one of the first rear plate and the frame in a manner that allows the mass to move relative to the first rear plate in the first or second direction. The mass is sized to yield a first force that is equal in magnitude and opposite in direction relative to a second force generated by moving components in the speaker and acoustic pressure of the speaker. The actuator is configured to move the mass in the second direction in phase with movement of the first voice coil in the first direction, and to move the mass in the first direction in phase with movement of the first voice coil in the second direction.

In one example, the actuator is an electromagnetic actuator.

In one example, the actuator includes a second rear plate, a second front plate, a second magnet, and a second voice coil. The second rear plate is attached to the first rear plate, the second rear plate including a base and a pole projecting from the base of the second rear plate, the pole of the second rear plate having an outer radial surface. The second front plate has an inner radial surface defining a hole through which the pole of the second rear plate extends, the outer radial surface of the pole of the second rear plate opposing the inner radial surface of the second front plate. The second magnet is disposed between the second rear plate and the second front plate and surrounds the pole of the second rear plate. The second voice coil is disposed between the outer radial surface of the pole of the second rear plate and the inner radial surface of the second front plate and is configured to move in the first or second direction when a voltage is applied to the second voice coil.

The present disclosure describes another example of a speaker assembly that includes a first rear plate, a first front plate, a first magnet, a first voice coil, a frame, a diaphragm, a mass, and an actuator. The first rear plate includes a base and a pole projecting from the base in a first direction, the pole of the first rear plate having an outer radial surface. The first front plate is mounted within the frame and has an inner radial surface defining a hole through which the pole of the first rear plate extends, the outer radial surface of the pole opposing the inner radial surface of the first front plate. The first magnet is disposed between the first rear plate and the first front plate and surrounding the pole of the first rear plate. The first voice coil is disposed between the outer radial surface of the pole of the first rear plate and the inner radial surface of the first front plate and is configured to move in the first direction or in a second direction opposite of the first direction when a voltage is applied to the first voice coil. The diaphragm extends between the first voice coil and the frame and is configured to generate noise in response to movement of the first voice coil. The mass is attached to at least one of the first rear plate and the frame in a manner that allows the mass to move relative to the first rear plate in the first or second direction. The actuator is configured to move the mass in the first direction out of phase with movement of the first voice coil in the first direction, and to move the mass in the second direction out of phase with movement of the first voice coil in the second direction.

In one example, the actuator is an electromagnetic actuator.

In one example, the actuator includes a second rear plate, a second front plate, a second magnet, and a second voice coil. The second rear plate is attached to the first rear plate and includes a base and a pole projecting from the base of the second rear plate, the pole of the second rear plate having an outer radial surface. The second front plate has an inner radial surface defining a hole through which the pole of the second rear plate extends, the outer radial surface of the pole of the second rear plate opposing the inner radial surface of the second front plate. The second magnet is disposed between the second rear plate and the second front plate and surrounds the pole of the second rear plate. The second voice coil is disposed between the outer radial surface of the pole of the second rear plate and the inner radial surface of the second front plate and is configured to move in the first or second direction when a voltage is applied to the second voice coil.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A speaker in a vehicle is typically mounted to an inner panel of the vehicle, such as a door panel or a rear shelf (parcel tray), using a speaker mount. When the speaker produces sound, the speaker generates a force due to moving components of the speaker, such as a voice coil, and due to acoustic pressure of the speaker caused by vibration of the diaphragm. This force is transmitted to the speaker mount, which may cause the interior panel and other components (e.g., trim, switches, and mirrors) of the vehicle to vibrate and generate an undesired noise such as a buzz, squeak, or rattle. Undesired noise and vibration may be generated by a speaker in a similar manner in applications other than vehicle applications, such as wall-mounted speakers, ceiling tile speakers, or inside a subwoofer enclosure.

To address this issue, a speaker assembly according to the present disclosure includes a speaker and a vibration reduction assembly that are mounted to a mounting structure, such as an interior panel of a vehicle, using a common mount. The vibration reduction assembly includes an actuator and a mass. The actuator may be electromechanical, pneumatic, or hydraulic. The actuator moves the mass out of phase with movement of the voice coil in the speaker to generate a force that is equal in magnitude and opposite in direction relative to the force generated by the speaker. Thus, the force generated by the vibration reduction assembly offsets the force generated by the speaker, which minimizes the force transmitted to the speaker mount. As a result, the undesired noise generated by speaker may be reduced.

In one example, the vibration reduction assembly has the structure of a typical speaker except that the vibration reduction assembly includes a mass attached to the voice coil and does not include a diaphragm or surround. In this example, the actuator of the vibration reduction assembly includes the components that cause the mass to move (e.g., the magnet, the voice coil, the electrical circuit supplying power to the voice coil). Omitting the diaphragm and surround reduces the cost and size of the speaker assembly. However, since the vibration reduction assembly does not include a diaphragm, the mass is included in the assembly, and the mass is sized to generate a force that offsets the force generated due to the acoustic pressure of the speaker.

Figure 1:
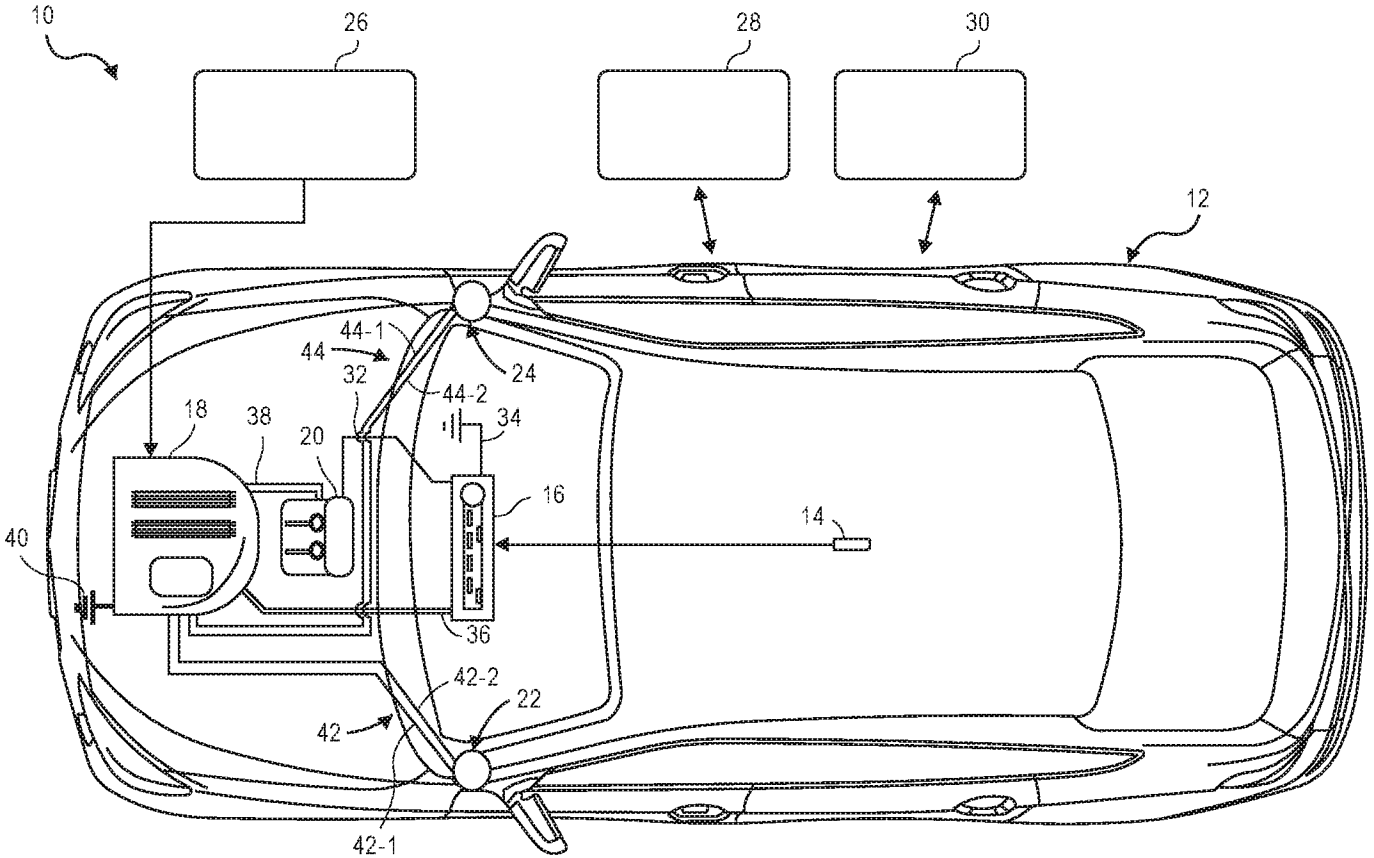
FIG. 1 is a schematic of an example of a vehicle including an amplifier and a speaker assembly, the speaker assembly including a speaker and an assembly for reducing vibration generated by the speaker according to the present disclosure.

Referring now to FIG. 1, an example vehicle 10 includes a vehicle body 12, an antenna 14, a radio 16, an amplifier 18, a battery 20, a left speaker assembly 22, a right speaker assembly 24, and an amplifier control module 26. The antenna 14 intercepts radio waves, converts the radio waves into radio signals (e.g., alternating currents), and sends the radio signals to the radio 16. The radio waves may include amplitude modulation (AM) radio waves and/or frequency modulation (FM) radio waves generated by a radio tower 28. Additionally or alternatively, the radio waves may include satellite radio waves generated by a satellite 30. The radio 16 includes a receiver that extracts a desired radio frequency from the radio signals to obtain a radio audio signal. The radio 16 may also include a media player that reads media (e.g., compact disc, DVD) and generates a media audio signal in response thereto.

The radio 16 outputs an audio signal (e.g., the radio audio signal and/or the media audio signal) to the amplifier 18. The amplifier 18 is electrically connected to the battery 20 and amplifies (i.e., increases the amplitude of) the audio signal using power from the battery 20. The amplifier 18 outputs the amplified audio signal to the left and right speaker assemblies 22 and 24. In various implementations, the amplifier 18 may be omitted, and the radio 16 may output the audio signal directly to the left and right speaker assemblies 22 and 24.

In the example shown, the radio 16 is powered by the battery 20 via a power wire 32, is grounded via a ground 34, and sends audio signals to the amplifier 18 via an audio wire 36. In addition, the amplifier 18 is power by the battery 20 via a power wire 38, is grounded via a ground 40, sends audio signals to the left speaker assembly 22 via left audio wires 42, and sends audio signals to the right speaker assembly 24 via right audio wires 44. The left audio wires 42 include a left positive audio wire 42-1 and a left negative audio wire 42-2, and the right audio wires 44 include a right positive audio wire 44-1 and a right negative audio wire 44-2.

Each of the left and right speaker assemblies 22 and 24 includes a speaker and a vibration reduction assembly that are both mounted to an interior panel (not shown) of the vehicle 10, such as a door panel, using a common speaker mount. The speaker includes components (e.g., voice coil, diaphragm) that move in response to the audio signals from the amplifier 18 and thereby generate sound waves. The vibration reduction assembly includes a mass that is moved out of phase with the moving components of the speaker to generate a force that is equal in magnitude and opposite in direction to the force that is generated by the moving components of the speaker and acoustic pressure of the speaker. Thus, the vibration reduction assembly reduces the amount of vibration that is transmitted from the speaker to the interior panel of the vehicle 10 through the speaker mount.

The amplifier control module 26 may be part of the amplifier 18. The amplifier control module 26 controls the amplitude, frequency, and/or phase of the audio signals sent from the amplifier 18 to the left and right speaker assemblies 22 and 24. In one example, the amplifier 18 includes a first channel associated with the left audio wires 42 and a second channel associated with the right audio wires 44. In this example, the amplifier control module 26 may control the amplitude, frequency, and/or phase of the audio signals output by the first channel independent of the amplitude, frequency, and/or phase of the audio signals output by the second channel and vice versa.

In another example, the amplifier 18 includes first and second channels that output signals to the left speaker assembly 22, and the amplifier 18 includes third and fourth channels that output signals to the right speaker assembly 24. The first and second channels send signals to the speaker and the vibration reduction assembly, respectively, of the left speaker assembly 22. The third and fourth channels send signals to the speaker and the vibration reduction assembly, respectively, of the right speaker assembly 24. The masses of the vibration reduction assemblies in the left and right speaker assemblies 22 and 24 are moved in response to the signals output by the second and fourth channels, respectively. In this example, the amplifier control module 26 may control the amplitude, frequency, and/or phase of the signals output by the first channel independent of the amplitude, frequency, and/or phase of the signals output by the second channel and vice versa. In addition, the amplifier control module 26 may control the amplitude, frequency, and/or phase of the signals output by the third channel independent of the amplitude, frequency, and/or phase of the signals output by the fourth channel and vice versa.

Figure 2:
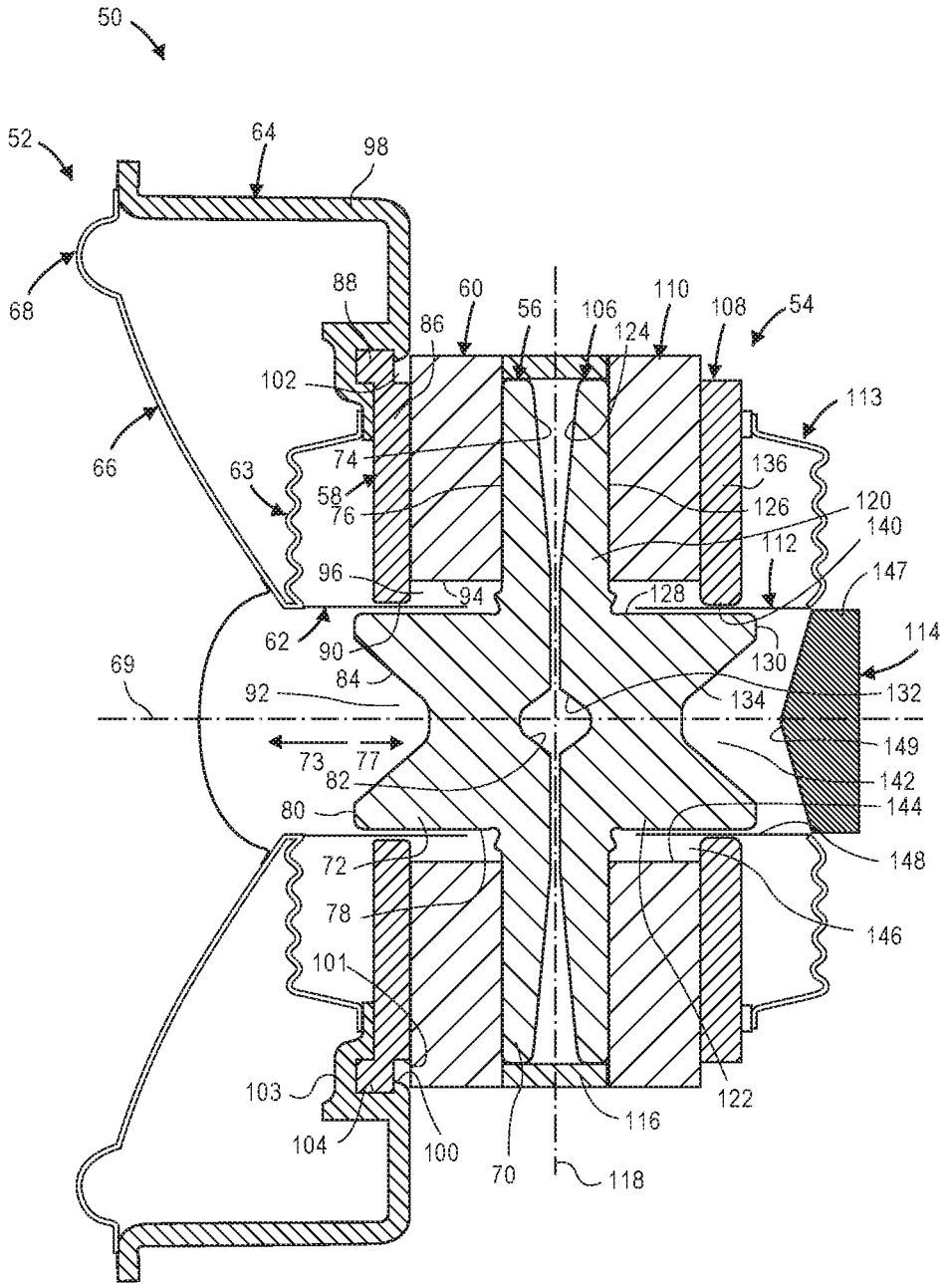
FIG. 2 is a section view of an example of a speaker assembly according to the present disclosure.

Referring now to FIG. 2, an example speaker assembly 50 may be used as the left speaker assembly 22 or the right speaker assembly 24. The speaker assembly 50 includes a speaker 52 and a vibration reduction assembly 54. The speaker 52 includes a rear plate 56, a front plate 58, a magnet 60, a voice coil 62, a suspension 63, a basket or frame 64, a cone or diaphragm 66, and a surround 68. The rear plate 56, the front plate 58, the magnet 60, the voice coil 62, and the diaphragm 66 are concentric with respect to a longitudinal axis 69 of the speaker assembly 50.

The rear plate 56 includes a base 70 and a pole 72 projecting from the base 70 in a first direction 73 parallel to the longitudinal axis 69. The base 70 has a disc shape with a concave end surface 74 and a flat end surface 76 opposite of the concave end surface 74. The pole 72 projects from the flat end surface 76 and has a cylindrical shape with an outer radial surface 78 and an axial end surface 80. A conical indentation 82 extends into the concave end surface 74 of the base 70, and a conical indentation 84 extends into the axial end surface 80 of the pole 72.

The front plate 58 includes a disc-shaped body 86 and a mounting ring 88 disposed radially outward of the disc-shaped body 86 and projecting axially from the disc-shaped body 86 in the first direction 73. The disc-shaped body 86 of the front plate 58 has an inner radial surface 90 defining a hole 92 through which the pole 72 of the rear plate 56 extends. The outer radial surface 78 of the pole 72 on the rear plate 56 opposes the inner radial surface 90 of the front plate 58.

The magnet 60 is disposed axially between the rear plate 56 and the front plate 58 and has a disc shape with an inner radial surface 94 defining a hole 96 through which the pole 72 of the rear plate 56 extends. Thus, the inner radial surface 94 of the magnet 60 surrounds the pole 72 of the rear plate 56. The magnet 60 is a permanent magnet that generates a magnetic field without an electrical current.

The voice coil 62 has a tubular shape and is disposed radially between the outer radial surface 78 of the pole 72 and the inner radial surface 90 of the front plate 58. The suspension 63 attaches the voice coil 62 to the frame 64 and allows the voice coil 62 to move in the first direction 73 or in a second direction 77 opposite of the first direction 73. When a voltage is applied to the voice coil 62, the voice coil 62 generates a magnetic field. Depending on the polarity of the voltage applied, the voice coil 62 repels or attracts the magnet 60, which causes the voice coil 62 to move in the first or second direction 73 or 77, respectively. The voice coil 62 moves axially in the first or second direction 73 or 77 within a radial gap between the outer radial surface 78 of the pole 72 and the inner radial surface 90 of the front plate 58.

The frame 64 includes a cup-shaped body 98 having an inner radial surface 100 defining a hole 102 within which the front plate 58 is disposed. Thus, the inner radial surface 100 of the frame 64 opposes and outer radial surface 101 of the front plate 58. In addition, the frame 64 includes a mounting flange 103 that projects axially from the cup-shaped body 98 in the first direction 73 and projects radially inward from the cup-shaped body 98 to define an annular mounting pocket 104. The mounting ring 88 on the front plate 58 is inserted into the annular mounting pocket 104 in the frame 64 to mount the front plate 58 within the frame 64. The rear plate 56 and the magnet 60 may also be mounted within the frame 64.

The diaphragm 66 has a conical shape and extends between the voice coil 62 and the frame 64, and the diaphragm 66 generates noise in response to movement of the voice coil 62. More specifically, in response to movement of the voice coil 62, the diaphragm 66 vibrates and thereby cases air pressure fluctuations that yield sound waves. The diaphragm 66 is directly attached to the voice coil 62 and is attached to the frame 64 via the surround 68. The surround 68 keeps the diaphragm 66 and the voice coil 62 centered about the longitudinal axis 69 while allowing the diaphragm 66 to move axially.

The vibration reduction assembly 54 includes a rear plate 106, a front plate 108, a magnet 110, a voice coil 112, a suspension 113, and a mass 114. The rear plate 106, the front plate 108, the magnet 110, the voice coil 112, and the mass 114 are concentric with respect to the longitudinal axis 69 of the speaker assembly 50. The vibration reduction assembly 54 is substantially similar to the speaker 52 except that the vibration reduction assembly 54 does not include a diaphragm or a surround, and the speaker 52 does not include a mass such as the mass 114. In various implementations, the vibration reduction assembly 54 may not include a diaphragm, but may include a secondary suspension or surround similar to the surround 68. The surround may attach the voice coil 112 and/or the suspension 113 to the frame 64 and may keep the voice coil 112 centered about the longitudinal axis 69 while allowing the voice coil 112 to move axially.

In addition, the vibration reduction assembly 54 is not mounted directly to the frame 64. Rather, the vibration reduction assembly 54 is attached to the speaker 52 via a rigid attachment ring 116 and, as discussed above, the speaker 52 is directly mounted to the frame 64. In other words, the vibration reduction assembly 54 is mounted to the frame 64 through the speaker 52. In addition, the frame 64 may be mounted to the interior panel of the vehicle 10 using, for example, fasteners such that the speaker 52 and the vibration reduction assembly 54 are mounted to the interior panel via a common speaker mount (i.e., the frame 64). In various implementations, the vibration reduction assembly 54 may be directly mounted to the frame 64, and the speaker 52 may be attached to the vibration reduction assembly 54 using, for example, the rigid attachment ring 116. In other words, the speaker 52 may be mounted to the frame 64 through vibration reduction assembly 54. In other implementations, both the speaker 52 and the vibration reduction assembly 54 may be directly mounted to the frame 64.

Further, the vibration reduction assembly 54 is oriented in an opposite direction than the speaker 52 with respect to a plane 118 disposed axially between the speaker and the vibration reduction assembly 54. In other words, the vibration reduction assembly 54 appears as a mirror image of the speaker 52 with respect to the plane 118 with the exception of the frame 64, the diaphragm 66, the surround 68, and the mass 114. Thus, the speaker assembly 50 is symmetric with respect to the plane 118 with the exception of the frame 64, the diaphragm 66, the surround 68, and the mass 114.

The rear plate 106 includes a base 120 and a pole 122 projecting from the base 120 in the second direction 77. The base 120 has a disc shape with a concave end surface 124 and a flat end surface 126 opposite of the concave end surface 124. The pole 122 projects from the flat end surface 126 and has a cylindrical shape with an outer radial surface 128 and an axial end surface 130. A conical indentation 132 extends into the concave end surface 124 of the base 120, and a conical indentation 134 extends into the axial end surface 130 of the pole 122. The vibration reduction assembly 54 is oriented such that the concave end surface 124 of the rear plate 106 faces the concave end surface 74 of the rear plate 56 of the speaker 52.

The front plate 108 includes a disc-shaped body 136 having an inner radial surface 140 defining a hole 142 through which the pole 122 of the rear plate 106 extends. The outer radial surface 128 of the pole 122 on the rear plate 106 opposes the inner radial surface 140 of the front plate 108. Since the vibration reduction assembly 54 is not mounted directly to the frame 64, the front plate 108 does not include a mounting ring, such as the mounting ring 88 of the front plate 58 of the speaker 52, for mounting the front plate 108 within the frame 64.

The magnet 110 is disposed axially between the rear plate 106 and the front plate 108 and has a disc shape with an inner radial surface 144 defining a hole 146 through which the pole 122 of the rear plate 106 extends. Thus, the inner radial surface 144 of the magnet 110 surrounds the pole 122 of the rear plate 106. The magnet 110 is a permanent magnet that generates a magnetic field without an electrical current.

The voice coil 112 has a tubular shape and is disposed radially between the outer radial surface 128 of the pole 122 and the inner radial surface 140 of the front plate 108. The suspension 113 attaches the voice coil 112 to the frame 64 and allows the voice coil 112 to move in the first or second direction 73 or 77. When a voltage is applied to the voice coil 112, the voice coil 112 generates a magnetic field. Depending on the polarity of the voltage applied, the voice coil 112 repels or attracts the magnet 110, which causes the voice coil 112 to move in the first or second direction 73 or 77, respectively. The voice coil 112 moves axially in the first or second direction 73 or 77 within a radial gap between the outer radial surface 128 of the pole 122 and the inner radial surface 140 of the front plate 108.

As discussed above, the vibration reduction assembly 54 is oriented in an opposite direction than the speaker 52 with respect to the plane 118. Thus, if the two assemblies were structurally identical, applying a voltage to the voice coil 112 having the same polarity, amplitude, frequency, and phase of the voltage applied to the voice coil 62 would cause the movements of the voice coils 62, 112 to be equal in magnitude and opposite in direction. In addition, a first force transmitted to the frame 64 due to movement of components in the vibration reduction assembly 54 such as the voice coil 112 would be equal in magnitude and opposite in direction than a second force generated due to movement of component in the speaker 52 such as the voice coil 62.

However, due to the diaphragm 66, movement of the voice coil 62 causes acoustic pressure which adds to the magnitude of the second force generated due to moving components of the speaker 52. Thus, the vibration reduction assembly 54 includes the mass 114. In addition, the mass 114 is sized such that the first force generated due to moving components of the vibration reduction assembly 54 is equal in magnitude and opposite in direction relative to the second force generated due to moving components of the speaker 52 and the acoustic pressure of the speaker 52. Therefore, the first and second forces offset one another, and little to no vibration is transmitted from the speaker assembly 50 to the frame 64 due to moving components of the speaker assembly 50 and acoustic pressure of the speaker 52.

In addition to or instead of adjusting the size of the mass 114 to generate a force that offsets the force generated due to the acoustic pressure of the speaker 52, the power consumed by the vibration reduction assembly 54 may be adjusted for this purpose. When the vibration reduction assembly 54 consumes the same amount of power as the speaker 52, or about the same amount of power as the speaker 52, the first force generated by the vibration reduction assembly 54 is equal to, and therefore offsets, the second force generated by the speaker 52. However, the acoustic pressure of the speaker 52 adds to the impedance of the speaker 52. Thus, if the speaker 52 and the vibration reduction assembly 54 are supplied with voltages having the same amplitude, the speaker 52 may consume more power than the vibration reduction assembly 54. Therefore, the first force generated by the vibration reduction assembly 54 may be insufficient to offset the second force generated by the speaker.

To address this issue, the impedance of the voice coil 112 may be adjusted to a level that is greater than the impedance of the voice coil 62 so that the amount of power consumed by the vibration reduction assembly 54. In turn, if the speaker 52 and the vibration reduction assembly 54 are supplied with voltages having the same amplitude, the speaker 52 and the vibration reduction assembly 54 may consume the same amount of power. The impedance of the voice coil 112 may be adjusted by adjusting the number of turns, diameter, or layers of the voice coil 112.

Additionally or alternatively, the amplifier control module 26 may adjust the amplitude of the voltage output from the amplifier 18 to the vibration reduction assembly 54 to adjust the amount of the power consumed by the vibration reduction assembly 54. For example, the amplifier 18 may include a first channel that supplies power to the speaker 52 and a second channel that supplies power to the vibration reduction assembly 54. The amplifier control module 26 may set the voltage output of the first channel to a first level and set the voltage output of the second channel to a second level that is less than the first level. In turn, since the impedance of the speaker 52 may be elevated due to the acoustic pressure thereof, the speaker 52 and the vibration reduction assembly 54 may consume the same amount of power or about the same amount of power. In one example, the amplifier control module 26 may adjust the voltage output of the second channel so that the amount of power consumed by the vibration reduction assembly 54 is within a predetermined range of the amount of power consumed by the speaker 52.

In another example, the average resistance of the speaker 52 is 28 Ohms, the current flowing though the speaker 52 is 107 milliamps (mA), and the voltage supplied to the speaker 52 is 3 volts. Therefore, the power supplied to the speaker 52 is 321 milliwatts (mW). In contrast, the average resistance of the vibration reduction assembly 54 is 20 Ohms, the current flowing though the vibration reduction assembly 54 is 127 mA, and the voltage supplied to the speaker 52 is 2.5 volts. Therefore, the power supplied to the vibration reduction assembly 54 is 320 mW (i.e., about the same as the amount of power supplied to the speaker 52).

The mass 114 includes a disc 147 attached to an inner radial surface 148 of the voice coil 112, and a conical tip 149 protruding from the disc 147 in the first direction 73. The mass 114 may be attached to the inner radial surface 148 of the voice coil 112 using a fastener and/or adhesive. The mass 114 is shaped to prevent contact between the mass 114 and the pole 122 of the rear plate 106 as the mass 114 moves with the voice coil 112 in the first direction 73.

Figure 3:
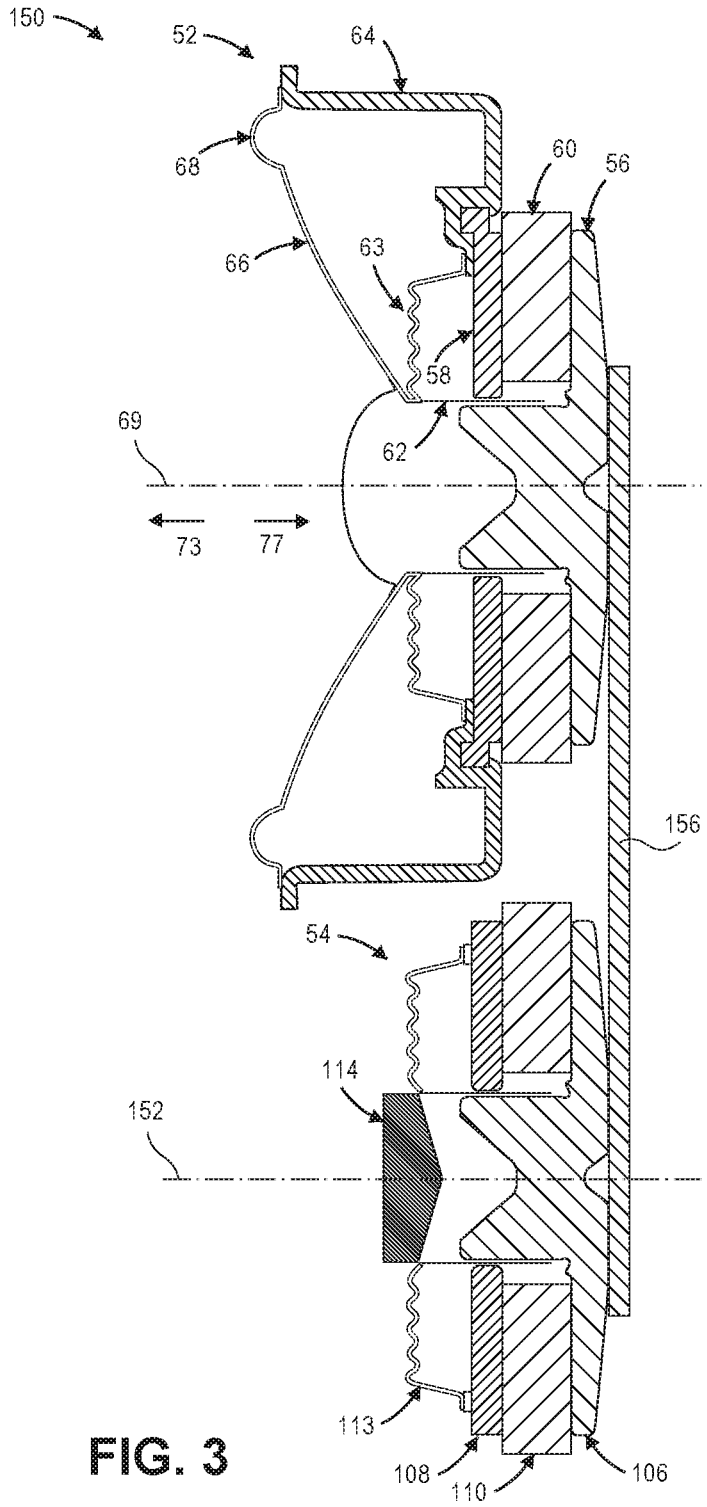
FIG. 3 is a section view of another example of a speaker assembly according to the present disclosure.

Referring now to FIG. 3, an example speaker assembly 150 may also be used as the left speaker assembly 22 and/or the right speaker assembly 24. Similar to the speaker assembly 50, the speaker assembly 150 includes the speaker 52 and the vibration reduction assembly 54. However, in the speaker assembly 150, the speaker 52 and the vibration reduction assembly 54 are oriented in the same direction. Thus, the pole 122 on the rear plate 106 projects from the base 120 of the rear plate 106 in the first direction 73 instead of the second direction 77. In addition, in the speaker assembly 150, the rear plate 106, the front plate 108, the magnet 110, the voice coil 112, and the mass 114 are concentric with respect to a longitudinal axis 152 of the vibration reduction assembly 54 rather than the longitudinal axis 69. The longitudinal axis 152 is parallel to and offset from the longitudinal axis 69.

Further, in the speaker assembly 150, the vibration reduction assembly 54 is attached to the speaker 52 via a rigid attachment arm 156 instead of the rigid attachment ring 116. The rigid attachment arm 156 may be a bar, plate, or disc. The rigid attachment arm 156 is attached to the concave end surfaces 74, 124 of the rear plates 56, 106 using, for example, fasteners and/or adhesive.

As discussed above, the speaker 52 and the vibration reduction assembly 54 are oriented in the same direction in the speaker assembly 150. Thus, applying a voltage to the voice coil 112 having the same polarity, amplitude, frequency, and phase of the voltage applied to the voice coil 62 would cause the movements of the voice coils 62, 112 to be equal in magnitude and direction. In this case, the first force transmitted to the frame 64 due to moving components in the vibration reduction assembly 54 would be equal in magnitude and direction to the second force generated due to moving components and acoustic pressure in the speaker 52. If the first force was in the same direction as the second force, the first force would not offset the second force to reduce the amount of vibration transmitted from the speaker assembly 150 to the frame 64.

To address this issue, the voice coil 112 of the vibration reduction assembly 54 may be driven out of phase relative to the voice coil 62 of the speaker 52. For example, the voltage applied to the voice coil 112 may have the same polarity, amplitude, and frequency as the voltage applied to the voice coil 62, but the voltage applied to the voice coil 112 may be 180 degrees out of phase relative to the voltage applied to the voice coil 62. Alternatively, the voltage applied to the voice coil 112 may have the same amplitude, frequency, and phase as the voltage applied to the voice coil 62, but the voltage applied to the voice coil 112 may be opposite in polarity relative to the voltage applied to the voice coil 62. In either case, applying the first and second voltages to the voice coils 62, 112, respectively, causes the movements of the voice coils 62, 112 to be equal in magnitude and opposite in direction. In turn, the first force transmitted to the frame 64 due to moving components in the vibration reduction assembly 54 is equal in magnitude and opposite in direction to the second force generated due to moving components and acoustic pressure in the speaker 52. As a result, the first force offsets the second force, and little to no vibration is transmitted from the speaker assembly 150 to the frame 64.

Referring now to FIGS. 4-8, examples of electrically wiring connections that may be used to electrically connect the speaker assemblies 50, 150 of FIGS. 2 and 3 to the amplifier 18 of FIG. 1 are shown. In FIGS. 4-8, the amplifier 18 and the speaker assembly 50 are represented in schematic form for ease of discussion. In addition, the amplifier 18 includes a positive terminal 158 and a negative terminal 160, the speaker 52 includes a positive terminal 162 and a negative terminal 164, and the vibration reduction assembly 54 includes a positive terminal 166 and a negative terminal 168.

Figure 4:
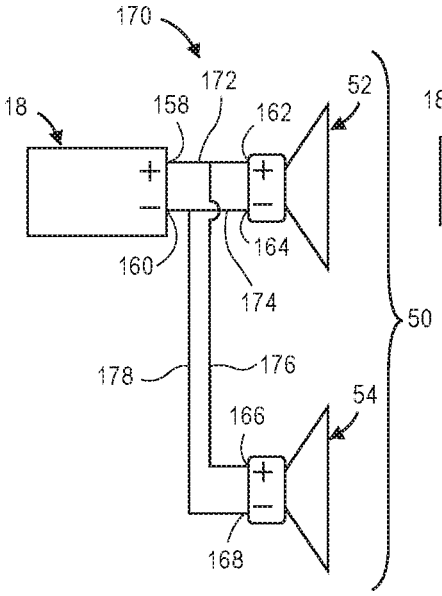
FIGS. 4 through 8 are schematics of example electrical wiring connections between the amplifier of FIG. 1 and the speaker assemblies of FIGS. 2 and 3.

FIG. 4 shows example electrical wiring connections 170 that may be used with the speaker assembly 50 of FIG. 2 to electrically connect the speaker 52 and the vibration reduction assembly 54 to the amplifier 18 of FIG. 1 in parallel so that the voltages supplied to the speaker 52 and the vibration reduction assembly 54 have the same polarity. The wiring connections 170 include a first wire 172, a second wire 174, a third wire 176, and a fourth wire 178. The wires 172, 174, 176, and 178 may be used in place of the wires 42-1, 42-2, 44-1, and 44-2 of FIG. 1. The first wire 172 connects the positive terminal 162 of the speaker 52 to the positive terminal 158 of the amplifier 18. The second wire 174 connects the negative terminal 164 of the speaker 52 to the negative terminal 160 of the amplifier 18.

The third wire 176 connects the positive terminal 166 of the vibration reduction assembly 54 to the first wire 172. Thus, the third wire 176 connects the positive terminal 166 of the vibration reduction assembly 54 to the positive terminal 158 of the amplifier 18. The fourth wire 178 connects the negative terminal 168 of the vibration reduction assembly 54 to the second wire 174. Thus, the fourth wire 178 connects the negative terminal 168 of the vibration reduction assembly 54 to the negative terminal 160 of the amplifier 18.

So, the positive terminals 162, 166 of the speaker assembly 50 are both connected to the positive terminal 158 of the amplifier 18, and the negative terminals 164, 168 of the speaker assembly 50 are both connected to the negative terminal 160 of the amplifier 18. Thus, the polarity, amplitude, frequency, and phase of the voltage applied to the voice coil 112 of the vibration reduction assembly 54 is the same as polarity, amplitude, frequency, and phase of the voltage applied to the voice coil 62 of the speaker 52. As a result, movement of the voice coil 112 relative to the rear plate 106 is in phase with movement of the voice coil 62 relative to the rear plate 56. In other words, the voice coil 112 moves away from the rear plate 106 as the voice coil 62 moves away from the rear plate 56, and the voice coil 112 moves toward the rear plate 106 as the voice coil 62 moves toward the rear plate 56. In addition, in the speaker assembly 50, the speaker 52 and the vibration reduction assembly 54 are oriented in opposite directions. Thus, the first force generated due to the moving components of the vibration reduction assembly 54 is equal in magnitude and opposite in direction relative to the second force generated due to the moving components and acoustic pressure of the speaker 52.

Figure 5:
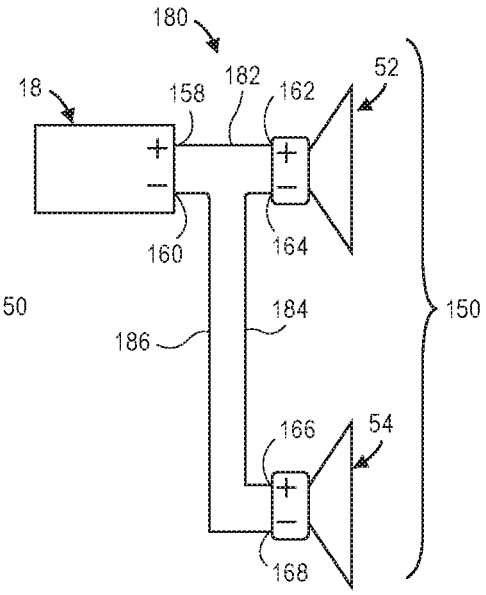

FIG. 5 shows example electrical wiring connections 180 that may be used with the speaker assembly 50 of FIG. 2 to electrically connect the speaker 52 and the vibration reduction assembly 54 to the amplifier 18 of FIG. 1 in series so that the voltages supplied to the speaker 52 and the vibration reduction assembly 54 have the same polarity. The wiring connections 180 include a first wire 182, a second wire 184, and a third wire 186. The wires 182, 184, and 186 may be used in place of the wires 42-1, 42-2, 44-1, and 44-2 of FIG. 1. The first wire 182 connects the positive terminal 162 of the speaker 52 to the positive terminal 158 of the amplifier 18.

The second wire 174 connects the positive terminal 166 of the vibration reduction assembly 54 to the negative terminal 164 of the speaker 52. Thus, the positive terminal 166 of the vibration reduction assembly 54 is connected to the positive terminal 160 of the amplifier 18 via the first and second wires 182 and 184. The third wire 176 connects the negative terminal 168 of the vibration reduction assembly 54 to the negative terminal 160 of the amplifier 18. Thus, the negative terminal 164 of the speaker 52 is connected to the negative terminal 160 of the amplifier 18 via the second and third wires 184 and 186.

So, the positive terminals 162, 166 of the speaker assembly 50 are both connected to the positive terminal 158 of the amplifier 18, and the negative terminals 164, 168 of the speaker assembly 50 are both connected to the negative terminal 160 of the amplifier 18. Thus, the polarity, amplitude, frequency, and phase of the voltage applied to the voice coil 112 of the vibration reduction assembly 54 is the same as polarity, amplitude, frequency, and phase of the voltage applied to the voice coil 62 of the speaker 52. As a result, movement of the voice coil 112 relative to the rear plate 106 is in phase with movement of the voice coil 62 relative to the rear plate 56. In addition, in the speaker assembly 50, the speaker 52 and the vibration reduction assembly 54 are oriented in opposite directions. Thus, the first force generated due to the moving components of the vibration reduction assembly 54 is equal in magnitude and opposite in direction relative to the second force generated due to the moving components and acoustic pressure of the speaker 52.

Figure 6:
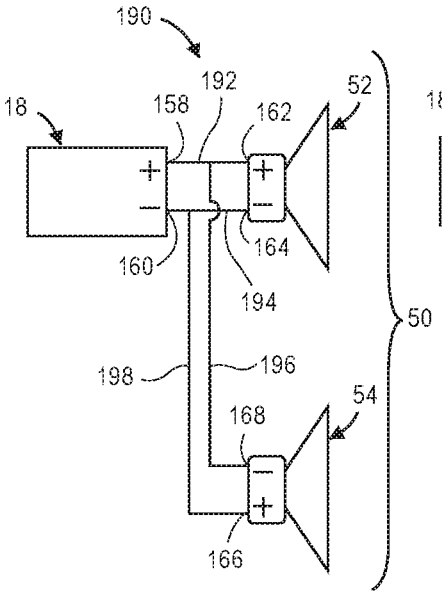

FIG. 6 shows example electrical wiring connections 190 that may be used with the speaker assembly 150 of FIG. 3 to electrically connect the speaker 52 and the vibration reduction assembly 54 to the amplifier 18 of FIG. 1 in parallel so that the voltages supplied to the speaker 52 and the vibration reduction assembly 54 are opposite in polarity. The wiring connections 190 include a first wire 192, a second wire 194, a third wire 196, and a fourth wire 198. The wires 192, 194, 196, and 198 may be used in place of the wires 42-1, 42-2, 44-1, and 44-2 of FIG. 1. The first wire 192 connects the positive terminal 162 of the speaker 52 to the positive terminal 158 of the amplifier 18. The second wire 194 connects the negative terminal 164 of the speaker 52 to the negative terminal 160 of the amplifier 18.

The third wire 196 connects the negative terminal 168 of the vibration reduction assembly 54 to the first wire 192. Thus, the third wire 196 connects the negative terminal 168 of the vibration reduction assembly 54 to the positive terminal 158 of the amplifier 18. The fourth wire 198 connects the positive terminal 166 of the vibration reduction assembly 54 to the second wire 194. Thus, the fourth wire 198 connects the positive terminal 166 of the vibration reduction assembly 54 to the negative terminal 160 of the amplifier 18.

The positive and negative terminals 158 and 160 of the amplifier 18 may be collectively referred to as a channel of the amplifier 18. Since the speaker 52 and the vibration reduction assembly 54 receive power from the same channel of the amplifier 18, the amplitude, frequency, and phase of the voltage applied to the voice coil 112 of the vibration reduction assembly 54 is the same as amplitude, frequency, and phase of the voltage applied to the voice coil 62 of the speaker 52. However, the positive and negative terminals 166 and 168 of the vibration reduction assembly 54 are connected to the positive and negative terminals 158 and 160 of the amplifier 18 in reverse relative to the way in which the positive and negative terminals 162 and 164 of the speaker 52 are connected to the positive and negative terminals 158 and 160 of the amplifier 18. Thus, the polarity of the voltage applied to the voice coil 112 of the vibration reduction assembly 54 is opposite of the polarity of the voltage applied to the voice coil 62 of the speaker 52. As a result, movement of the voice coil 112 relative to the rear plate 106 is out of phase with movement of the voice coil 62 relative to the rear plate 56. In other words, the voice coil 112 moves away from the rear plate 106 as the voice coil 62 moves toward the rear plate 56, and the voice coil 112 moves toward the rear plate 106 as the voice coil 62 moves away from the rear plate 56. In addition, in the speaker assembly 150, the speaker 52 and the vibration reduction assembly 54 are oriented in the same direction. Thus, the first force generated due to the moving components of the vibration reduction assembly 54 is equal in magnitude and opposite in direction relative to the second force generated due to the moving components and acoustic pressure of the speaker 52.

Figure 7:
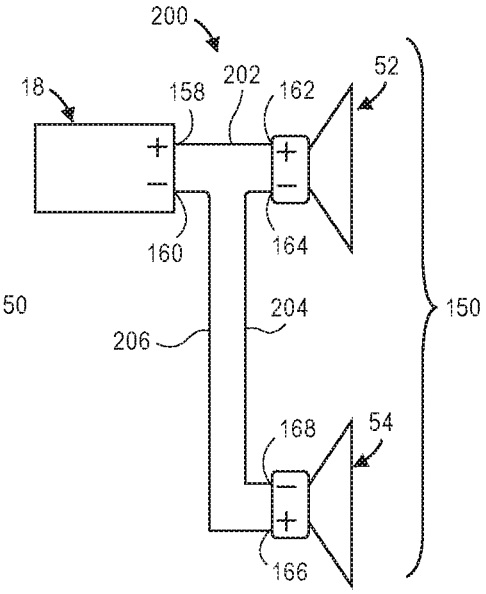

FIG. 7 shows example electrical wiring connections 200 that may be used with the speaker assembly 150 of FIG. 3 to electrically connect the speaker 52 and the vibration reduction assembly 54 to the amplifier 18 of FIG. 1 in series so that the voltages supplied to the speaker 52 and the vibration reduction assembly 54 are opposite in polarity. The wiring connections 200 include a first wire 202, a second wire 204, and a third wire 206. The wires 202, 204, and 206 may be used in place of the wires 42-1, 42-2, 44-1, and 44-2 of FIG. 1.

The first wire 202 connects the positive terminal 162 of the speaker 52 to the positive terminal 158 of the amplifier 18. The second wire 204 connects the negative terminal 168 of the vibration reduction assembly 54 to the negative terminal 164 of the speaker 52. Thus, the negative terminal 168 of the vibration reduction assembly 54 is connected to the positive terminal 160 of the amplifier 18 via the first and second wires 202 and 204. The third wire 206 connects the positive terminal 166 of the vibration reduction assembly 54 to the negative terminal 160 of the amplifier 18. Thus, the negative terminal 164 of the speaker 52 is connected to the negative terminal 160 of the amplifier 18 via the second and third wires 204 and 206.

Since the speaker 52 and the vibration reduction assembly 54 receive power from the same channel of the amplifier 18, the amplitude, frequency, and phase of the voltage applied to the voice coil 112 of the vibration reduction assembly 54 is the same as amplitude, frequency, and phase of the voltage applied to the voice coil 62 of the speaker 52. However, the positive and negative terminals 166 and 168 of the vibration reduction assembly 54 are connected to the positive and negative terminals 158 and 160 of the amplifier 18 in reverse relative to the way in which the positive and negative terminals 162 and 164 of the speaker 52 are connected to the positive and negative terminals 158 and 160 of the amplifier 18. Thus, the polarity of the voltage applied to the voice coil 112 of the vibration reduction assembly 54 is opposite of the polarity of the voltage applied to the voice coil 62 of the speaker 52. As a result, movement of the voice coil 112 relative to the rear plate 106 is out of phase with movement of the voice coil 62 relative to the rear plate 56. In addition, in the speaker assembly 150, the speaker 52 and the vibration reduction assembly 54 are oriented in the same direction. Thus, the first force generated due to the moving components of the vibration reduction assembly 54 is equal in magnitude and opposite in direction relative to the second force generated due to the moving components and acoustic pressure of the speaker 52.

Figure 8:
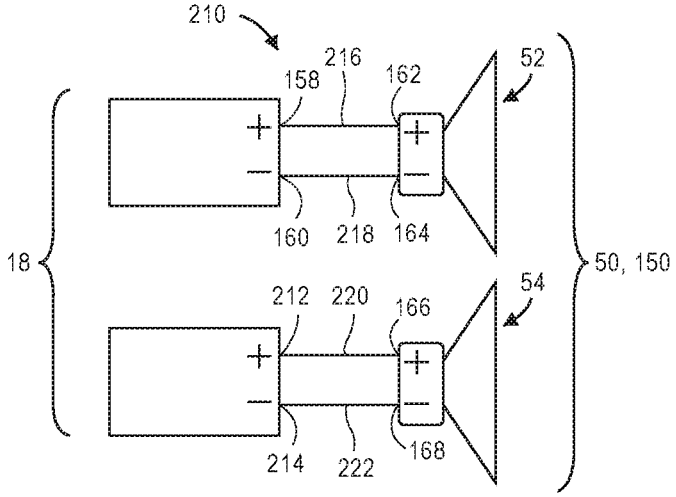

FIG. 8 shows example electrical wiring connections 210 that may be used with the speaker assembly 50 of FIG. 2 or the speaker assembly 150 to electrically connect the speaker 52 and the vibration reduction assembly 54 to the amplifier 18 of FIG. 1. In FIG. 8, the amplifier 18 includes a positive terminal 212 and a negative terminal 214 in addition to the positive terminal 158 and the negative terminal 160. The positive and negative terminals 158 may be collectively referred to as a first channel of the amplifier 18, and the positive and negative terminals 212 and 214 may be collectively referred to as a second channel of the amplifier 18. Thus, while the amplifier 18 is shown as including a single channel in FIGS. 4-7, the amplifier 18 is shown as including a pair of channels in FIG. 8.

The wiring connections 210 include a first wire 216, a second wire 218, a third wire 220, and a fourth wire 222. The wires 216, 218, 220, and 222 may be used in place of the wires 42-1, 42-2, 44-1, and 44-2 of FIG. 1. The first wire 216 connects the positive terminal 162 of the speaker 52 to the positive terminal 158 of the amplifier 18. The second wire 218 connects the negative terminal 164 of the speaker 52 to the negative terminal 160 of the amplifier 18. The third wire 220 connects the positive terminal 166 of the vibration reduction assembly 54 to the positive terminal 158 of the amplifier 18. The fourth wire 222 connects the negative terminal 168 of the vibration reduction assembly 54 to the negative terminal 160 of the amplifier 18.

The amplifier control module 26 may control the amplitude, frequency, and phase of the voltage output by the first channel of the amplifier 18 independent of the amplitude, frequency, and phase of the voltage output by the second channel of the amplifier 18. Conversely, the amplifier control module 26 may control the amplitude, frequency, and phase of the voltage output of the second channel independent of the amplitude, frequency, and phase of the voltage output of the first channel. Thus, the amplifier control module 26 may adjust the voltage output of the second channel to have the same amplitude and frequency as the voltage output of the first channel. In addition, the amplifier control module 26 may adjust the voltage output of the second channel to be in phase with or (e.g., 180 degrees) out of phase from the voltage output of the first channel depending on whether the speaker 52 and the vibration reduction assembly 54 are oriented in opposite directions or the same direction.

In one example, for the speaker assembly 50, the amplifier control module 26 adjusts the voltage output of the second channel of the amplifier 18 to have the same amplitude and frequency as the voltage output of the first channel of the amplifier 18. In addition, the amplifier control module 26 adjusts the voltage output of the second channel to be in phase with the voltage output of the first channel. Thus, movement of the voice coil 112 relative to the rear plate 106 is in phase with movement of the voice coil 62 relative to the rear plate 56. In addition, in the speaker assembly 50, the speaker 52 and the vibration reduction assembly 54 are oriented in opposite directions. Thus, the first force generated due to the moving components of the vibration reduction assembly 54 is equal in magnitude and opposite in direction relative to the second force generated due to the moving components and acoustic pressure of the speaker 52.

In another example, for the speaker assembly 150, the amplifier control module 26 adjusts the voltage output of the second channel of the amplifier 18 to have the same amplitude and frequency as the voltage output of the first channel of the amplifier 18. In addition, the amplifier control module 26 adjusts the voltage output of the second channel to be out of phase from the voltage output of the first channel. Thus, movement of the voice coil 112 relative to the rear plate 106 is out of phase with movement of the voice coil 62 relative to the rear plate 56. In addition, in the speaker assembly 150, the speaker 52 and the vibration reduction assembly 54 are oriented the same direction. Thus, the first force generated due to the moving components of the vibration reduction assembly 54 is equal in magnitude and opposite in direction relative to the second force generated due to the moving components and acoustic pressure of the speaker 52. Therefore, the two-channel arrangement of FIG. 8 may be used as an alternative to the electrical connections 190, 210 of FIGS. 5 and 7, which supply voltages to the speaker 52 and the vibration reduction assembly 64 that are opposite in polarity.

In another example, for the speaker assembly 50 or 150, the amplifier control module 26 adjusts the voltage output of the second channel of the amplifier 18 to have the same frequency as the voltage output of the first channel of the amplifier 18. In addition, the amplifier control module 26 adjusts the voltage output of the second channel to be in phase with or out of phase from the voltage output of the first channel depending on whether the speaker 52 and the vibration reduction assembly 54 are oriented in opposite directions or the same direction. Further, the amplifier control module 26 sets the voltage output of the second channel to have a smaller amplitude than the voltage output of the first channel to offset a decrease in power consumed by the speaker 52 due to the impedance of the acoustic pressure. In turn, the speaker 52 and the vibration reduction assembly 54 may consume the same amount of power, and the second force generated by the vibration reduction assembly 54 may be equal to the first force generated by the speaker 52.

Figure 9:
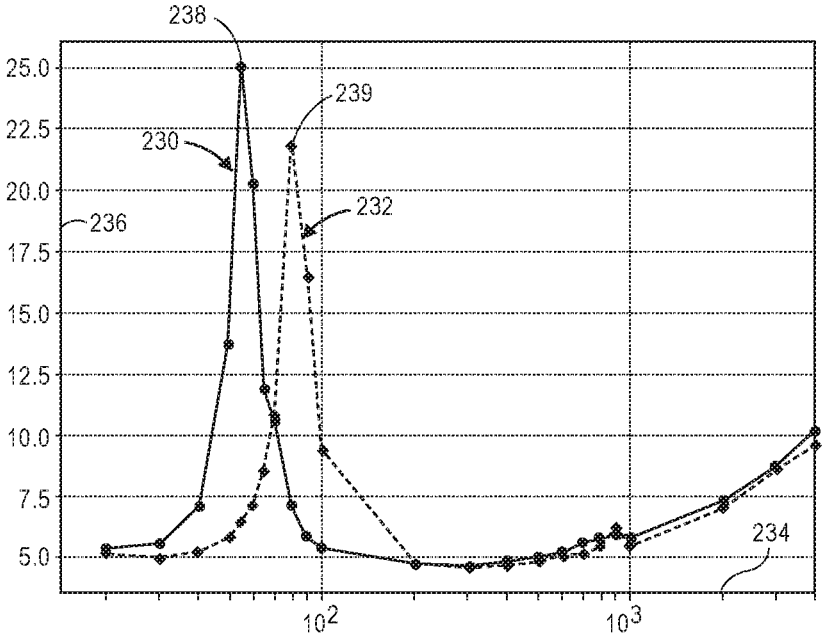
FIGS. 9 and 10 are graphs illustrating example impedances of a speaker and a vibration reduction assembly according to the present disclosure.

Referring now to FIG. 9, an example impedance 230 of the speaker 52 and an example impedance 232 of a vibration reduction assembly are plotted with respect to an x-axis 234 that represents frequency in hertz (Hz) and a y-axis 236 that represents impedance in Ohms. The impedance 232 represents the impedance of the vibration reduction assembly 54 without the mass 114. The impedance 230 of the speaker 52 has a resonance frequency at 238 (approximately 45 Hz), and the impedance of the vibration reduction assembly 54 has a resonance frequency at 239 (approximately 65 Hz). Thus, the resonance frequency of the vibration reduction assembly 54 is different than the resonance frequency of the speaker 52. Therefore, the forces generated by the vibration reduction assembly 54 may not offset the forces generated by the speaker 52 as effectively as possible.

Figure 10:
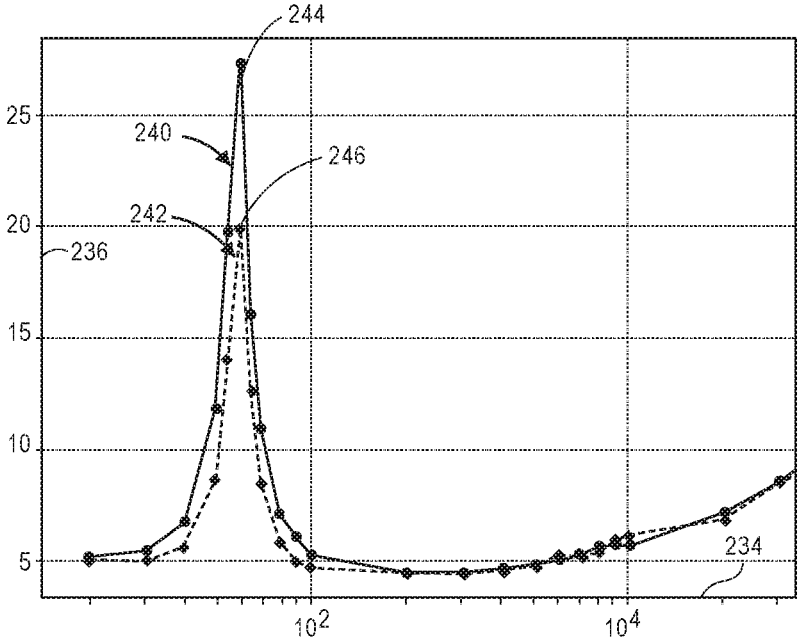

Referring now to FIG. 10, an example impedance 240 of the speaker 52 and an example impedance 242 of the vibration reduction assembly 54 are plotted with respect to the x-axis 234 and the y-axis 236. The impedance 242 represents the impedance of the vibration reduction assembly 54 with the mass 114.

As shown in FIG. 10, the impedance 240 of the speaker 52 has a resonance frequency at 244 (approximately 50 Hz), and the impedance 242 of the vibration reduction assembly 54 has a resonance frequency at 246 (approximately 50 Hz). Thus, the resonance frequency of the vibration reduction assembly 54 is about the same as the resonance frequency of the speaker 52. Therefore, the forces generated by the vibration reduction assembly 54 offset the forces generated by the speaker 52, which reduces the amount of vibration in the interior panel to which the speaker assembly 50 or 150 is attached.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disc drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. An assembly for reducing vibration generated by a speaker, the vibration reduction assembly comprising:

a first rear plate including a base and a pole projecting from the base in a first direction, the pole having an outer radial surface;

a first front plate having an inner radial surface defining a hole through which the pole of the first rear plate extends, the outer radial surface of the pole opposing the inner radial surface of the first front plate;

a first magnet disposed between the first rear plate and the first front plate and surrounding the pole;

a first voice coil disposed between the outer radial surface of the pole and the inner radial surface of the first front plate and configured to move in the first direction or in a second direction opposite of the first direction when a voltage is applied to the first voice coil; and a mass attached to the first voice coil and sized to yield a first force that is equal in magnitude and opposite in direction relative to a second force generated by moving components in the speaker and acoustic pressure of the speaker.

2. The vibration reduction assembly of claim 1 wherein the vibration reduction assembly is free of any diaphragm.

3. The vibration reduction assembly of claim 1 wherein the first voice coil has a tubular shape, and the mass includes a disc attached to an inner radial surface of the first voice coil.

4. A speaker assembly including:

the vibration reduction assembly of claim 1; and the speaker, wherein the speaker includes:

a second rear plate attached to the first rear plate of the vibration reduction assembly, the second rear plate including a base and a pole projecting from the base of the second rear plate, the pole of the second rear plate having an outer radial surface;

a second front plate having an inner radial surface defining a hole through which the pole of the second rear plate extends, the outer radial surface of the pole of the second rear plate opposing the inner radial surface of the second front plate;

a second magnet disposed between the second rear plate and the second front plate and surrounding the pole of the second rear plate;

a second voice coil disposed between the outer radial surface of the pole of the second rear plate and the inner radial surface of the second front plate and configured to move in the first or second direction when a voltage is applied to the second voice coil;

a frame within which the second front plate is mounted; and a diaphragm extending between the second voice coil and the frame and configured to generate noise in response to movement of the second voice coil.

5. The speaker assembly of claim 4 wherein the pole of the second rear plate projects from the base of the second rear plate in the second direction.

6. An audio system including:

the speaker assembly of claim 5; and electrical wiring configured to electrically connect the speaker assembly to an amplifier such that movement of the first voice coil relative to the first rear plate is in phase with movement of the second voice coil relative to the second rear plate.

7. The audio system of claim 6 wherein the electrical wiring connects the first and second voice coils to the amplifier in series.

8. The audio system of claim 6 wherein the electrical wiring connects the first and second voice coils to the amplifier in parallel.

9. An audio system including:

the speaker assembly of claim 5; and an amplifier control module configured to supply a first voltage to the first voice coil and supply a second voltage to the second voice coil, wherein the first voltage is less than the second voltage.

10. The speaker assembly of claim 4 wherein the pole of the second rear plate projects from the base of the second rear plate in the first direction.

11. An audio system including:

the speaker assembly of claim 10; and electrical wiring configured to electrically connect the speaker assembly to an amplifier such that movement of the first voice coil relative to the first rear plate is out of phase with movement of the second voice coil relative to the second rear plate.

12. The audio system of claim 11 wherein the electrical wiring connects the first and second voice coils to the amplifier in series.

13. The audio system of claim 11 wherein the electrical wiring connects the first and second voice coils to the amplifier in parallel.

14. An audio system including:

the speaker assembly of claim 10; and an amplifier control module configured to control an amplifier to send a first signal to the first voice coil and send a second signal to the second voice coil such that movement of the first voice coil relative to the first rear plate is out of phase with movement of the second voice coil relative to the second rear plate.

15. A speaker assembly comprising:

a speaker including:

a first rear plate including a base and a pole projecting from the base in a first direction, the pole of the first rear plate having an outer radial surface;

a first front plate having an inner radial surface defining a hole through which the pole of the first rear plate extends, the outer radial surface of the pole opposing the inner radial surface of the first front plate;

a first magnet disposed between the first rear plate and the first front plate and surrounding the pole of the first rear plate;

a first voice coil disposed between the outer radial surface of the pole of the first rear plate and the inner radial surface of the first front plate and configured to move in the first direction or in a second direction opposite of the first direction when a voltage is applied to the first voice coil;

a frame within which the first front plate is mounted; and a diaphragm extending between the first voice coil and the frame and configured to generate noise in response to movement of the first voice coil; and a vibration reduction assembly including:

a mass attached to at least one of the first rear plate and the frame in a manner that allows the mass to move relative to the first rear plate in the first or second direction, wherein the mass is sized to yield a first force that is equal in magnitude and opposite in direction relative to a second force generated by moving components in the speaker and acoustic pressure of the speaker; and an actuator configured to:

move the mass in the second direction in phase with movement of the first voice coil in the first direction; and move the mass in the first direction in phase with movement of the first voice coil in the second direction.

16. The speaker assembly of claim 15 wherein the actuator is an electromagnetic actuator.

17. The speaker assembly of claim 16 wherein the actuator includes:

a second rear plate attached to the first rear plate, the second rear plate including a base and a pole projecting from the base of the second rear plate, the pole of the second rear plate having an outer radial surface;

a second front plate having an inner radial surface defining a hole through which the pole of the second rear plate extends, the outer radial surface of the pole of the second rear plate opposing the inner radial surface of the second front plate;

a second magnet disposed between the second rear plate and the second front plate and surrounding the pole of the second rear plate; and a second voice coil disposed between the outer radial surface of the pole of the second rear plate and the inner radial surface of the second front plate and configured to move in the first or second direction when a voltage is applied to the second voice coil.

18. A speaker assembly including:

a first rear plate including a base and a pole projecting from the base in a first direction, the pole of the first rear plate having an outer radial surface;

a first front plate having an inner radial surface defining a hole through which the pole of the first rear plate extends, the outer radial surface of the pole opposing the inner radial surface of the first front plate;

a first magnet disposed between the first rear plate and the first front plate and surrounding the pole of the first rear plate;

a first voice coil disposed between the outer radial surface of the pole of the first rear plate and the inner radial surface of the first front plate and configured to move in the first direction or in a second direction opposite of the first direction when a voltage is applied to the first voice coil;

a frame within which the first front plate is mounted;

a diaphragm extending between the first voice coil and the frame and configured to generate noise in response to movement of the first voice coil;

a mass attached to at least one of the first rear plate and the frame in a manner that allows the mass to move relative to the first rear plate in the first or second direction; and an actuator configured to:

move the mass in the first direction out of phase with movement of the first voice coil in the first direction; and move the mass in the second direction out of phase with movement of the first voice coil in the second direction.

19. The speaker assembly of claim 18 wherein the actuator is an electromagnetic actuator.

20. The speaker assembly of claim 19 wherein the actuator includes:

a second rear plate attached to the first rear plate, the second rear plate including a base and a pole projecting from the base of the second rear plate, the pole of the second rear plate having an outer radial surface;

a second front plate having an inner radial surface defining a hole through which the pole of the second rear plate extends, the outer radial surface of the pole of the second rear plate opposing the inner radial surface of the second front plate;

a second magnet disposed between the second rear plate and the second front plate and surrounding the pole of the second rear plate; and a second voice coil disposed between the outer radial surface of the pole of the second rear plate and the inner radial surface of the second front plate and configured to move in the first or second direction when a voltage is applied to the second voice coil.

* * * * *